US006857211B2

(12) United States Patent
Grasso

(10) Patent No.: US 6,857,211 B2
(45) Date of Patent: Feb. 22, 2005

(54) THREE-DIMENSIONAL LABEL FOR A CONTAINER AND METHOD OF FORMING THE SAME

(75) Inventor: Andre W. Grasso, Garrison, NY (US)

(73) Assignee: Stephen J. Osborn, Marlboro, NY (US)

( * ) Notice: Subject to any disclaimer, the term of this patent is extended or adjusted under 35 U.S.C. 154(b) by 0 days.

(21) Appl. No.: 09/818,113

(22) Filed: Mar. 27, 2001

(65) Prior Publication Data

US 2002/0139018 A1 Oct. 3, 2002

(51) Int. Cl.[7] ..... G09F 3/00
(52) U.S. Cl. ..... 40/310
(58) Field of Search ..... 40/310, 630, 638

(56) References Cited

U.S. PATENT DOCUMENTS

| | | | | | |
|---|---|---|---|---|---|
| 2,296,752 | A | | 9/1942 | Whetzel | |
| 3,890,449 | A | * | 6/1975 | Mezquita | 426/127 |
| 3,984,005 | A | | 10/1976 | Amberg | |
| 4,115,939 | A | | 9/1978 | Marks | |
| 4,597,814 | A | | 7/1986 | Colgate, Jr. | |
| 5,022,950 | A | | 6/1991 | Ingalls et al. | |
| 5,358,770 | A | * | 10/1994 | Evans | 40/310 |
| 5,457,515 | A | | 10/1995 | Quadracci et al. | |
| 5,561,930 | A | | 10/1996 | Ashley et al. | |
| 5,857,275 | A | * | 1/1999 | Deal | 40/310 |
| 5,937,554 | A | | 8/1999 | Haugk et al. | |
| 5,953,170 | A | | 9/1999 | Glancy | |
| 5,958,536 | A | * | 9/1999 | Gelsinger et al. | 283/81 |
| 5,967,032 | A | | 10/1999 | Bravenec et al. | |
| 5,972,480 | A | | 10/1999 | Yoshikawa et al. | |
| 6,023,872 | A | | 2/2000 | Falkenstein, Sr. | |
| 6,048,423 | A | * | 4/2000 | Barrash et al. | 156/86 |
| 6,062,409 | A | * | 5/2000 | Eberle | 215/381 |
| 6,073,373 | A | | 6/2000 | Haugk et al. | |
| 6,084,713 | A | | 7/2000 | Rosenthal | |
| 6,086,702 | A | * | 7/2000 | Rea | 156/247 |
| 6,213,520 | B1 | * | 4/2001 | Treleaven et al. | 283/81 |

* cited by examiner

*Primary Examiner*—S. Joseph Morano
*Assistant Examiner*—Robert J. McCarry, Jr.
(74) *Attorney, Agent, or Firm*—Schmeiser, Olsen & Watts

(57) ABSTRACT

A three-dimensional label for a container and a method of forming the label is disclosed. The label includes a first portion flush with a surface of the container, a second portion extending away from the surface of the container, and graphics.

11 Claims, 3 Drawing Sheets

THREE-DIMENSIONAL LABEL FOR A CONTAINER AND METHOD OF FORMING THE SAME

BACKGROUND OF THE INVENTION

1. Technical Field

The present invention relates generally to labeling, and more particularly, to a method of forming a unique three-dimensional label, and the label so formed.

2. Related Art

Many labels for containers, such as beverage containers, food containers, etc., have been limited to two-dimensional designs. Attempts have been made to create three-dimensional designs formed out of the container itself, such as embossing, casting, and so on. Similarly, containers have been formed, as disclosed in the patents to Haughk et al. (U.S. Pat. Nos. 5,937,554, and 6,073,373), wherein a portion of the label is placed within the container to give the label a three-dimensional effect. However, none have provided a three-dimensional label attachable to the surface of a container.

SUMMARY OF THE INVENTION

The first general aspect of the present invention provides a three-dimensional label for a container, comprising: a raised portion extending away from a surface of the container; and an adhesive material on a surface of the label attaching the label to the surface of the container.

The second general aspect of the present invention provides a container having a label affixed to a surface of the container, wherein the label includes a three-dimensional design.

The third general aspect of the present invention provides a method of forming a three-dimensional label for a container, comprising: creating an image on a first surface of a flexible material; causing at least a portion of the image to become deformed; and adhering a second surface of the flexible material to a surface of the container.

The foregoing and other features of the invention will be apparent from the following more particular description of the embodiments of the invention.

BRIEF DESCRIPTION OF THE DRAWINGS

The embodiments of this invention will be described in detail, with reference to the following figures, wherein like designations denote like elements, and wherein.

DESCRIPTION OF THE PREFERRED EMBODIMENTS

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc. Although the drawings are intended to illustrate the present invention, the drawings are not necessarily drawn to scale.

Figure 1B:
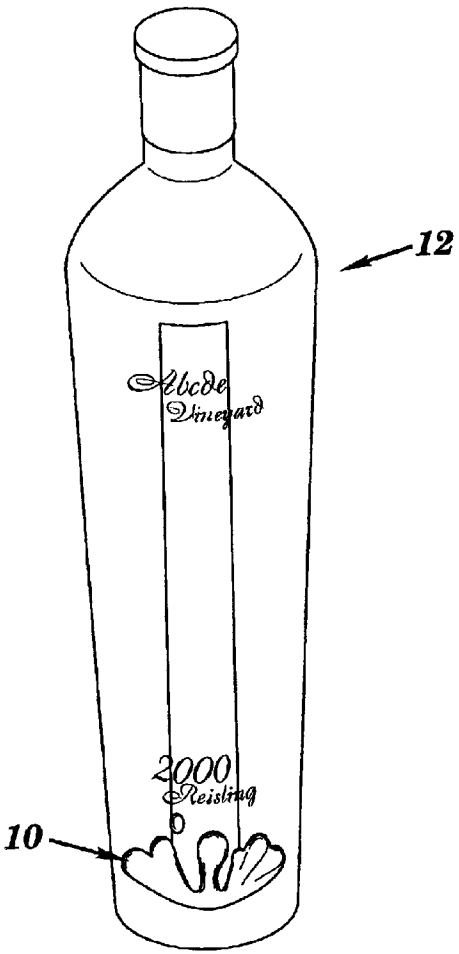
FIG. 1B depicts a container having a three-dimensional label thereon, in accordance with the present invention.
Figure 1A:
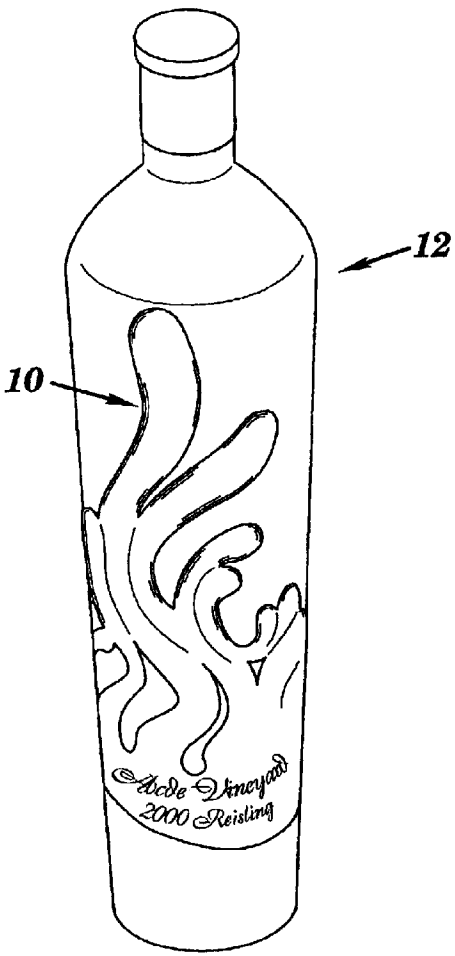
FIG. 1A depicts a container having a three-dimensional label thereon, in accordance with the present invention.
Figure 3:
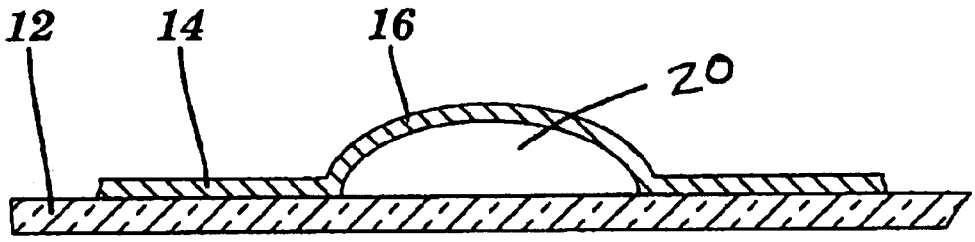
FIG. 3 depicts a cross-sectional view of the container and the three-dimensional label, in accordance with the present invention.

The present invention provides a three-dimensional advertising label 10 on a container 12, similar to the label 10 illustrated in FIGS. 1A and 1B. The container 12 may be a beverage container, such as a wine bottle, as shown in this example, a soda container, a juice container, a container for food products, a container for health and beauty items such as a shampoo container, or a container for pharmaceuticals and so on. As illustrated more clearly in FIG. 3, which shows a cross-sectional view of the label 10 and container 12, the label 10 may comprise a flat portion 14, or a portion laying flush with the surface of the container 12, and a raised or three-dimensional portion 16, or a portion extending outward from the surface of the container 12. Located between the raised or three-dimensional portion 16 and the surface of the container 12 is a vacancy, or space 20.

Figure 2B:
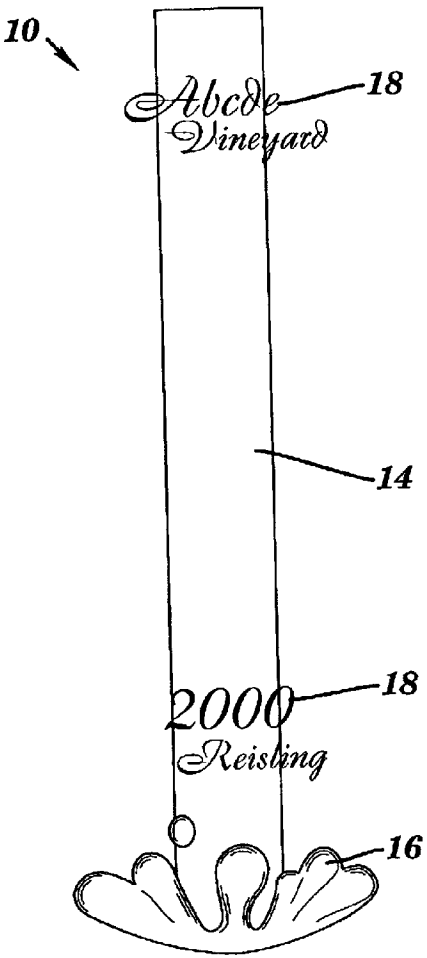
FIG. 2B depicts the three-dimensional label of FIG. 1B, in accordance with the present invention.
Figure 2A:
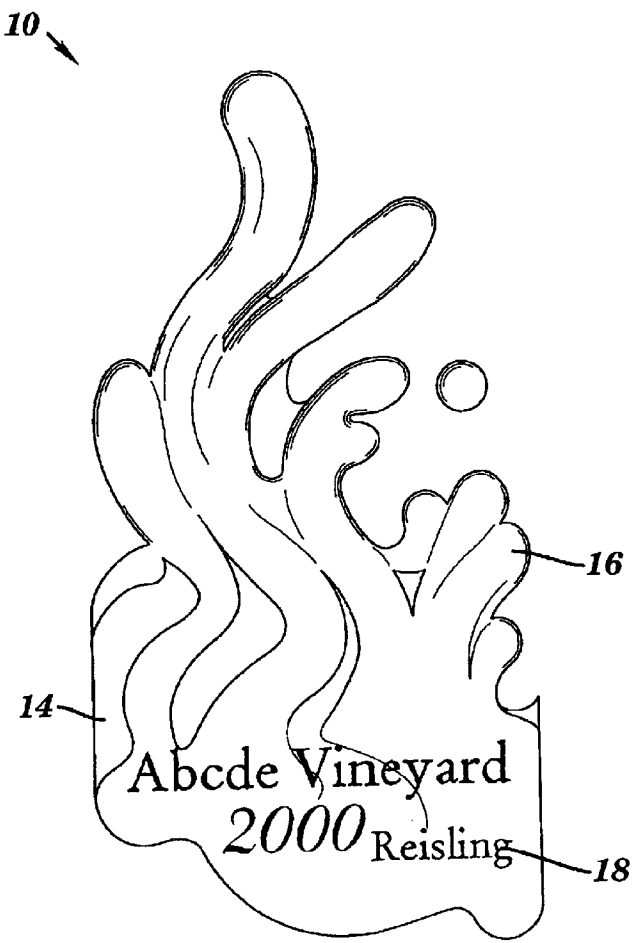
FIG. 2A depicts the three-dimensional label of FIG. 1A, in accordance with the present invention.

As illustrated in FIGS. 2A and 2B, the label 10 may also comprise graphics 18, such as a company name, the contents of the container 12, a logo, etc. In the examples illustrated herein, the containers 12 are wine bottles. The graphics 18 are printed on the flat portion 14 of the label 10, and the three-dimensional portion 16 takes the form of splashing wine.

The flat portion 14, the three-dimensional portion 16, and the graphics 18 may be formed using various colors. Likewise, the label 10 may take various shapes and sizes, and is in no way limited by the example illustrated herein. The label 10 may cover a portion of the container 12, as shown, or the entire container 12, and may be located on any area of the container 12 desired. Likewise, the label 10 may be formed without the flat portion 14, wherein the graphics 18 are printed within the three-dimensional portion 16. The label 10 may be formed without graphics 18. More than one label 10 may be placed on the container 12, as desired, and so on.

The label 10 may be formed using a process referred to as "distortion printing," or other similar process. For example, a label form and graphic design template is produced using a combination of solid modeling software, e.g., a pro/ENGINEER™ program, a mechanical desktop program, etc., and graphic and/or illustration software, e.g., 3-D studio™ max/viz, Corel™, etc.

The template is then printed onto the underside of a substantially planar sheet of flexible material, such as a clear PVC, PTEG, or other similar material, to form a printed blank. A screen printing process, offset lithography, flexographic and digital ink jet printing, or other similar process, may be used to print the template image onto the flexible material. Various color inks may be used to print the template onto the material, thereby providing a wide range of flexibility in the design of the finished label 10. Thermoformable inks, such as UV curable inks, may be used as they exhibit the characteristics necessary to withstand the subsequent processing, such as being malleable with the application of heat, resistant to melting and bubbling, flexible, adhesive, etc. Screen printing allows for a large quantity of templates to be formed on a flat sheet of material at one time, thereby reducing the time required to produce the label 10, however, other similar processes may also be used.

An adhesive material, to facilitate adhesion of the label 10 to the container 12, such as a double-faced adhesive sheet is applied to a back surface of the label 10 prior to formation of the three-dimensional form. The three-dimensional image is then formed into the blank using a thermoforming process, or other similar molding processes. For example, the blank is clamped into a thermoforming machine. Within the thermoforming machine the blank is exposed to an array of "zoned" heating elements that bring various portions of the blank to the appropriate temperature levels. Once the blank reaches the appropriate temperature levels, the blank begins to soften. The softened blank is then placed in contact with a molding tool within the thermoforming machine.

It should be noted that the label 10 may be formed using a single tool, or multiple tools, such as ganged tools, etc. For instance, for shallow images a male mold may be used wherein the mold is forced into the blank. For deeper images, a female mold may be used in conjunction with a vacuum forming process to draw the blank into the mold.

The molded label is then cooled, as needed, and removed from the thermoforming machine. When removing the molded label from the machine, there is the risk of ink delamination. This risk may be minimized by adjusting the heating zones within the machine, utilizing a mold-release spray, drying the ink for a longer period of time before attempting removal, etc.

The label 10 is then trimmed, as needed, using a die-cut process, routing process, or other similarly used process. Thereafter, the label 10 is applied to the container 12, either by hand, using an automated device, or other similarly used application process. Once applied to the container 12, a vacancy 12, or space, is formed between the three-dimensional portion 16 and the surface of the container 12.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A three-dimensional label for a container, comprising:

a clear material with a graphic template formed on a bottom surface thereof, wherein the graphic template is configured to form a raised portion of said label extending away from a surface of the container having only a vacancy between the raised portion of the label and the surface of the container;

a flat portion of said label, wherein said flat portion is flush with the surface of the container; and an adhesive material only on the flat portion of the label attaching the label to the surface of the container.

2. The three-dimensional label of claim 1, further comprising a flat portion flush with the surface of the container.

3. The three-dimensional label of claim 1, further comprising graphics.

4. The three-dimensional label of claim 1, wherein the container is a beverage container.

5. The three-dimensional label of claim 1, wherein the container is a wine bottle.

6. A container having a label affixed to a surface of the container, wherein the label includes a three-dimensional design portion, wherein the three-dimensional design portion extends away from the surface of the container thereby having only a vacancy formed between the three-dimensional design portion of the label and the surface of the container, further wherein an adhesive material is attached to a portion of the label that is not the three-dimensional design portion.

7. The container of claim 6, wherein the label further comprising a flat portion flush with a surface of the container.

8. The container of claim 6, wherein the container is a beverage container.

9. The container of claim 6, wherein the container is a wine bottle.

10. A three-dimensional label for a container, comprising:

a raised ornamental portion of said label extending away from a surface of the container;

a vacancy existing alone between said raised ornamental portion and said surface of the container;

a portion substantially flush with the surface of the container; and an adhesive material for attaching the label to the surface of the container, wherein the adhesive material is on the substantially flush portion.

11. A three-dimensional label for a container, comprising:

a clear flexible material having a printed graphic template formed on a bottom surface of the label;

a portion substantially flush with a surface of the container;

an adhesive material, wherein the adhesive material is only located between the substantially flush portion and the surface of the container; and a raised ornamental portion of said label formed from the printed graphic template, wherein the raised ornamental portion extends away from the surface of the container thereby creating only a vacancy between said raised ornamental portion and said surface of the container, wherein said vacancy does not include any adhesive material, further wherein the adhesive material is not adjacent the raised ornamental portion, further wherein the ornamental portion depicts a flowing liquid.

* * * * *